US008267280B2

(12) United States Patent
Kneer et al.

(10) Patent No.: US 8,267,280 B2
(45) Date of Patent: Sep. 18, 2012

(54) DEVICE FOR SEPARATELY STORING A SUBSTANCE, PREFERABLY A MEDICAL OR PHARMACEUTICAL SUBSTANCE, AND A LIQUID AND MIXING THE SAME PRIOR TO THE DELIVERY THEREOF

(75) Inventors: Stephan Kneer, Farchant (DE); Roland Kneer, Farchant (DE)

(73) Assignee: Gaplast GmbH, Altenau (DE)

( * ) Notice: Subject to any disclaimer, the term of this patent is extended or adjusted under 35 U.S.C. 154(b) by 367 days.

(21) Appl. No.: 12/680,457

(22) PCT Filed: Sep. 8, 2008

(86) PCT No.: PCT/DE2008/001505

§ 371 (c)(1),
(2), (4) Date: Mar. 26, 2010

(87) PCT Pub. No.: WO2009/039821

PCT Pub. Date: Apr. 2, 2009

(65) Prior Publication Data

US 2010/0219202 A1 Sep. 2, 2010

(30) Foreign Application Priority Data

Sep. 27, 2007 (DE) ..... 10 2007 046 625

(51) Int. Cl.
*B67D 1/00* (2006.01)

(52) U.S. Cl. ..... 222/83; 206/222

(58) Field of Classification Search ..... 222/82.83, 222/136, 321.6, 321.7, 321.9; 206/222, 119
See application file for complete search history.

(56) References Cited

U.S. PATENT DOCUMENTS

| | | | | |
|---|---|---|---|---|
| 3,080,094 | A * | 3/1963 | Modderno | 222/82 |
| 3,172,568 | A * | 3/1965 | Modderno | 222/80 |
| 3,655,096 | A * | 4/1972 | Easter | 222/82 |
| 4,770,323 | A | 9/1988 | Debard | |
| 5,421,483 | A * | 6/1995 | Parise | 222/82 |
| 5,642,838 | A * | 7/1997 | Stoody | 222/83 |
| 6,098,795 | A * | 8/2000 | Mollstam et al. | 206/222 |
| 6,230,884 | B1 | 5/2001 | Coory | |
| 6,412,659 | B1 * | 7/2002 | Kneer | 222/82 |
| 2003/0102329 | A1 * | 6/2003 | Ki | 222/129 |

FOREIGN PATENT DOCUMENTS

| | | | |
|---|---|---|---|
| DE | 19742559 C2 | | 5/1999 |
| JP | 2003-170979 | * | 6/2003 |

* cited by examiner

*Primary Examiner* — Lien Ngo
(74) *Attorney, Agent, or Firm* — Greer, Burns & Crain, Ltd.

(57) ABSTRACT

The device for separately storing a substance, such as a medical or pharmaceutical active substance, and a liquid, and for mixing the same prior to use, comprising a first receptacle containing the liquid, a second receptacle that contains the substance and has a bottom to be opened so that the substance passes into the liquid, and comprising a means that can be advanced in order to apply a force to the bottom of the second receptacle such that the bottom is opened, is characterized in that the second receptacle is a blister pack which is mounted inside or on the first receptacle. The substance is thereby sealed within a housing that has a preferably flat bottom and a substantially cup-shaped or blister-shaped upper chamber wall. The flat bottom is torn open in order to release the substance, with the chamber wall being preferably turned upside down through the bottom.

5 Claims, 3 Drawing Sheets

DEVICE FOR SEPARATELY STORING A SUBSTANCE, PREFERABLY A MEDICAL OR PHARMACEUTICAL SUBSTANCE, AND A LIQUID AND MIXING THE SAME PRIOR TO THE DELIVERY THEREOF

CROSS REFERENCE

This application is a U.S. National Phase under 35 U.S.C. §371 of International Application No. PCT/DE2008/001505, filed Sep. 8, 2008, which claims priority from German Patent Application No. 10 2007 046 625.2, filed Sep. 27, 2007.

FIELD OF THE INVENTION

The present invention relates to a device for separately storing a substance, such as a pharmaceutical active substance, and a liquid and for mixing the same prior to discharge, the device comprising a first receptacle containing the liquid, a second receptacle that contains the substance and has a bottom to be opened so that the substance can pass into the liquid, and comprising a means that can be advanced in order to apply a force to the bottom of the second receptacle such that the bottom is opened, further comprising a tubular insert which is inserted into a neck of the first receptacle, with the front part of a pump means displaceably engaging into the tubular insert and forming the force-exerting means.

The substance may be any substance in a solid or also liquid state, which is first to be stored separately from the liquid in the first receptacle and is mixed with said liquid prior to use. The substance may e.g. be composed of freeze-dried lactic acid bacteria which for probiotic applications are mixed with a suitable suspension liquid prior to application.

BACKGROUND

A device of the aforementioned type is disclosed in DE 197 42 559 C2 issued to the applicant of the present patent application. In the known device, the second receptacle containing the substance is formed by a tubular insert that is inserted into the neck of the first receptacle, which is shaped in the form of a bottle. A groove with a predetermined breaking point is formed on the bottom of the insert, so that the bottom can be broken or swung open by the action of a force, so that the substance falls into the liquid of the first receptacle. The bottom is opened by the front part of an airless pump which is displaceably arranged in the insert. When the airless pump is advanced in the longitudinal direction of the first receptacle, i.e. pushed into the receptacle, it breaks open the bottom of the insert.

In this known configuration the problem arises that, while the pump means is being pushed forwards or slid in, air is pressed into the suction area of the pump, which may lead to malfunctions during initial pumping of the liquid. If, in addition, as is the case with some applications e.g. in the medical or pharmaceutical or also hygienic sector, the contents of the receptacle is to remain sterile, this cannot be guaranteed with the prior-art device because the air pressed into the interior of the receptacle upon the advance movement of the pump may be contaminated.

U.S. Pat. No. 6,230,884 B1 discloses a receptacle cap with a blister pack which is opened by depressing a neck section of the cap, wherein a pin-like attachment presses a tablet out of the blister pack, with the tablet falling into the liquid contained in a bottle. Ambient air may here enter unimpededly into the bottle.

U.S. Pat. No. 4,770,323 deals with the problem to provide a sterile packaging for a fluid that is hermetically sealed by a breakable sealing membrane until the first discharge, wherein after the sealing membrane has been broken open an unhindered discharge of the receptacle contents is to be made possible for a long period of time. To this end a tubular perforation element is pressed through the sealing membrane and gets into engagement with a small rising tube in the receptacle, with the small rising tube being connected to a discharge channel that extends through the cap of the packaging. With this kind of packaging, air can also enter into the packaging after the sealing membrane has been broken open.

SUMMARY OF THE INVENTION

It is therefore the object of the present invention to provide a device in which the above-mentioned malfunctions are largely avoided during the initial pumping of the liquid.

This object is achieved according to the invention by a device for separately storing a substance, such as a pharmaceutical active substance, and a liquid, and for mixing the same prior to discharge, comprising a first receptacle containing the liquid, a second receptacle that contains the substance and has a bottom to be opened so that the substance can pass into the liquid, and a means that can be advanced in order to apply a force to the bottom of the second receptacle such that the bottom is opened. A tubular insert is inserted into a neck of the first receptacle, with the front part of a pump means displaceably engaging into the tubular insert and forming the force-exerting means. The front part of the pump means is held by a pump housing part which in a retracted initial position of the pump means defines an air chamber above the tubular insert. A wall of the pump housing part has formed therein at least one opening through which upon the advance movement of the pump means air escapes outside the first receptacle. The front part of the pump means is sealed on its outer circumference by an annular seal relative to the tubular insert.

Advantageous developments are further explained below.

According to the invention the front part of the pump means is held by a pump housing part which in the retracted initial position of the pump defines an air chamber above the tubular insert, and that a wall, preferably the circumferential wall of the pump housing part, has formed therein at least one opening that passes through the wall and through which, upon the advance movement of the airless pump, air escapes to the outside from the air chamber which is decreasing in size without said air entering into the first receptacle. Moreover, according to the invention it is provided that the front part of the pump means is sealed on its outer circumference by at least one annular seal relative to the tubular insert.

With this configuration it is possible to avoid malfunctions during the initial pumping action of the airless pump because upon the advance movement of the pump into the operative position no air will enter into the suction chamber of the pump. Moreover, the sterility of the receptacle contents is not jeopardized by the entry of possibly contaminated air.

Furthermore, it is suggested with advantage that the circumferential wall of the tubular insert comprises at least one opening extending through the wall, preferably one or a plurality of longitudinally extending slits that preferably extend from the free end of the tubular insert up to approximately half the height thereof. Liquid enters through said openings or slits into the insert and thus into the suction area of the pump, whereby air contained in the interior of the tubular insert can simultaneously exit through said slits.

This configuration has the consequence that upon the first putting into operation of the device one or two pumping operations of the airless pump are already enough for discharging the receptacle contents.

In a further embodiment of the invention it may be provided that the second receptacle is formed by a blister pack which is fastened to the tubular insert. The substance is here sealed within a housing which has preferably a flat bottom and a substantially cup-shaped or blister-shaped upper chamber wall. To release the substance, the flat bottom or the flat back wall is broken open, with the chamber wall being preferably turned upside down through the bottom.

Whenever a substance, e.g. a medical or pharmaceutical active substance, has to be safely protected against penetrating moisture, at least the bottom wall is made of an aluminum foil or an aluminum-containing multilayered foil, which might also apply to the chamber wall. PE-AL-PVC is given as an example of an aluminum-containing multilayered foil without the invention being limited thereto. The chamber wall may be made of LDPE (optionally provided with an aluminum layer).

Said blister pack is expediently secured to the tubular insert which can project into the first receptacle.

The fastening operation can be carried out in any suitable way, e.g. in that the rim of the blister pack, which has e.g. a width of 3 to 4 mm, is mounted by ultrasonic welding to the lower rim of the insert element; instead of this, a mounting by way of hot stamping is also possible. Other possibilities of fastening the blister pack are that said pack is e.g. firmly clamped with an outer cap or snapped tight with the insert element. As has already been mentioned, the fastening operation can be carried out in any suitable way.

The front part of the pump means, preferably the suction part of an airless part, is movably arranged and forms the force-exerting means with which the bottom of the blister pack can be broken open. To this end the front part of the pump means is advanced such that the bottom of the blister pack opens automatically.

Here, the arched chamber wall of the blister pack can be turned upside down through the broken bottom without being injured or broken open itself. In this case the blister pack continues to seal the lower opening of the tubular insert.

However, it may also be provided that a cutting means, which may e.g. by formed by a sharp-edged metal ring, is fastened to the free end of the front part of the pump means. In this case the arched chamber wall of the blister pack is also broken or cut open.

In an alternative design of the invention the tubular insert forms the second receptacle, as is the case with DE 197 42 559 C2.

According to the invention a situation is avoided where during opening of the bottom of the substance-containing second receptacle air is pressed into the interior of the liquid-containing receptacle through the advance movement of the suction end of the airless pump in the tubular insert. This happens irrespective of whether a blister pack is used as the receptacle for the substance or, as in the case of DE 197 42 595 C2, the tubular insert itself forms the second receptacle and has a bottom to be broken open. Since in the wall of the pump housing part above the tubular insert at least one preferably lateral wall opening is formed, through which during the advance movement of the pump means air escapes to the outside, and not into the first receptacle, and since the front part of the pump means is sealed on its outer circumference by an annular seal relative to the tubular insert, no air passes into the liquid-containing receptacle and thus also not into the suction chamber of the pump.

BRIEF DESCRIPTION OF THE DRAWINGS

Further details of the invention become apparent from the following description of preferred embodiments of the invention and from the drawings, wherein.

DETAILED DESCRIPTION OF PREFERRED EMBODIMENTS

Figure 1:
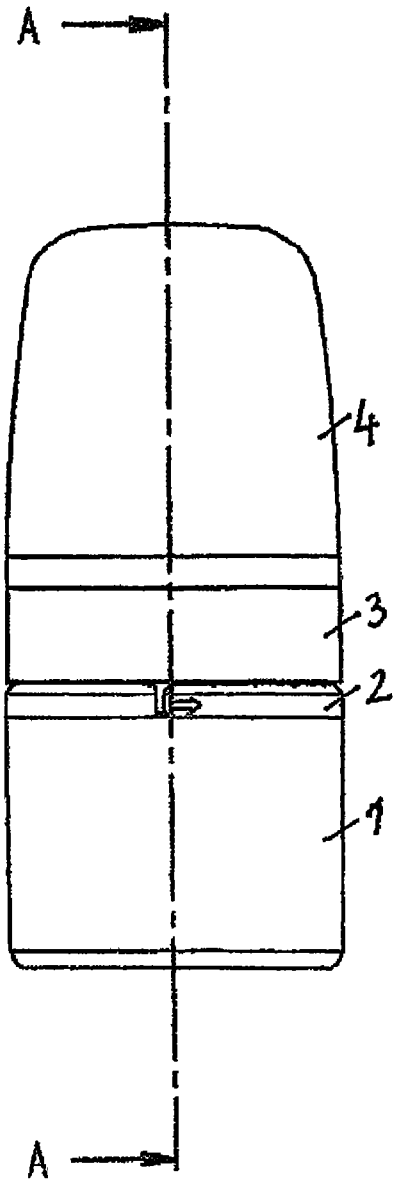
FIG. 1 is a side view of an embodiment of the device according to the invention.

As shown in FIG. 1, the device comprises a bottom cap 1, a tamper-evident tear-off ring 2 positioned thereabove, which is mounted on the lower rim of a housing part 3, and an upper cap 4. The upper cap 4 covers an airless pump, which is generally designated by 5, and must be removed prior to the operation thereof.

An approximately bottle-shaped receptacle 6, in which a liquid is contained, is seated in the bottom cap 1 and connected thereto for co-rotation. The neck of the receptacle 6 has inserted thereinto a tubular insert 7 which grips over the receptacle neck with an annular outer wall section 8. The front part or suction part 9 of the airless pump 5 is displaceably seated in the insert 7. The upper rim portion of the insert 7 has provided thereon an annular seal 10 which seals the space between the inner wall of the insert 7 and the outer wall of the suction part 9 of the pump 5.

The suction part 9 of the pump 5 is fastened to a pump housing part 11 which comprises a cylindrical circumferential wall 12, which abuts on the outside of the wall section 8 of the tubular insert 7, and an upper wall 12*a*, which abuts on the upper end portion of the suction part 9 and defines an annular chamber 13 together with the suction part 9 and the upper side of the annular insert 7. Holes or slits 14 that extend through the wall are provided in the circumferential wall 12 of the pump housing part 11.

In the lower portion the insert 7 also contains elongated openings 15 which extend through the wall and which can extend up to or end shortly above the lower edge of the insert 7.

The lower rim 16 of the insert 7 has a blister pack 17 fastened thereto in an appropriate way, for instance in that the rim of the blister pack 17 is firmly welded to the rim 16 of the insert 7. The blister pack 17 has a flat lower bottom 18 and an arched chamber wall 19 projecting upwards into the interior of the insert 7. The substance within the blister pack 17 is sealed in, whereby vapor diffusion into the interior of the blister pack can be excluded by suitably selecting the material of the walls 18 and 19.

Figure 2:
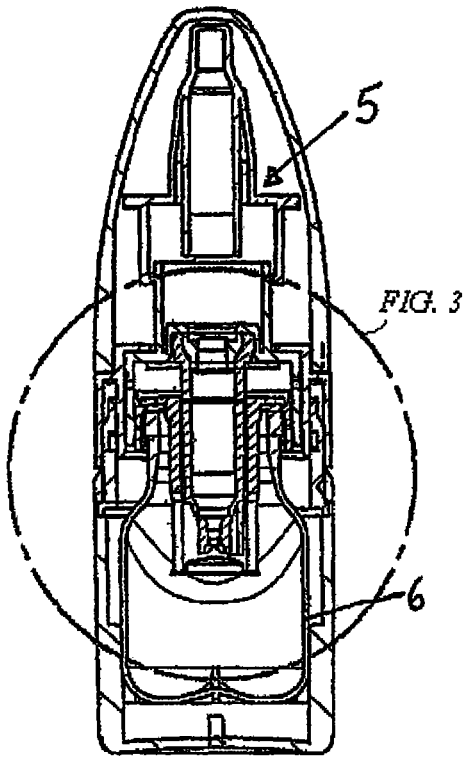
FIG. 2 is a section A-A through the device according to FIG. 1.
Figure 3:
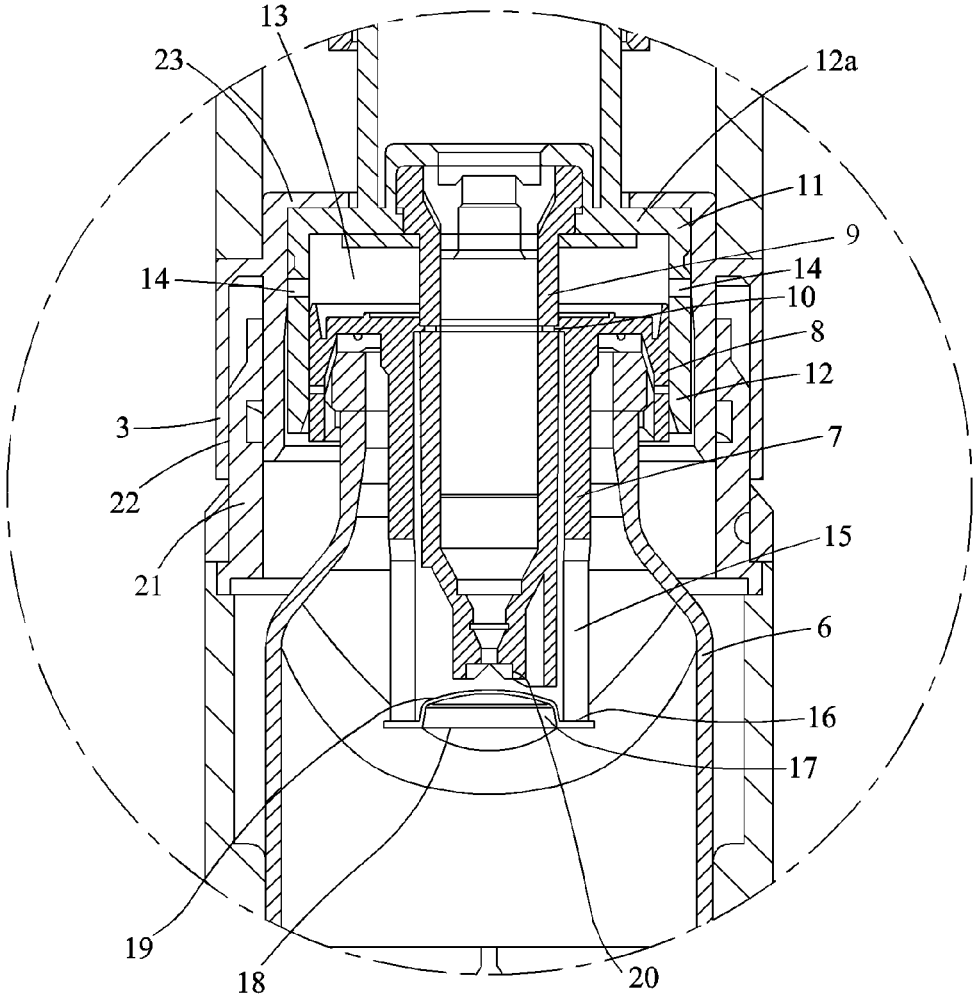
FIG. 3 is an enlarged illustration of the encircled area of FIG. 2.

In the initial position shown in FIGS. 2 and 3, the head end 20 of the suction part 9 of the pump 5 is spaced apart from the blister pack 17.

To mix the substance of the blister pack 17 with the liquid contained in the receptacle 6 or in an inner bag of the receptacle 6, the tear-off strip 2 is first removed, whereupon the pump 5 with its suction part 9 can be moved in the direction of the blister pack 17. To this end the housing part 3, the outer wall of which is in alignment with the outer walls of the lower cap 1 and of the upper cap 4 is in threaded engagement with an inwardly offset upper wall section 21 of the lower cap 1. The threaded engagement is illustrated in FIG. 3 by way of reference numeral 22. The housing part 3 can here also be rotated with the help of the upper cap 4 which, although it can be removed from the housing part 3 upwards, is connected to the cap for rotation therewith.

When the housing part 3 is screwed onto the wall section 21 downwards, its radially inner annular section 23 simultaneously entrains the pump housing part 11 and thus the suction part 9 of the pump 5 downwards, whereby the head end 20 of the suction part 9 impinges on the blister pack 17, tears open the bottom wall 18 and turns the upper chamber wall 19 downwards. Said state is shown in FIG. 4.

In this process air is displaced out of the annular chamber 13 through the wall openings 14 without said air passing into the interior of the tubular insert 7 because of the annular seal 10.

Receptacle liquid enters through the slits 15 into the suction portion of the pump part 9, from which air that may be contained therein can be displaced without any difficulty.

Figure 4:
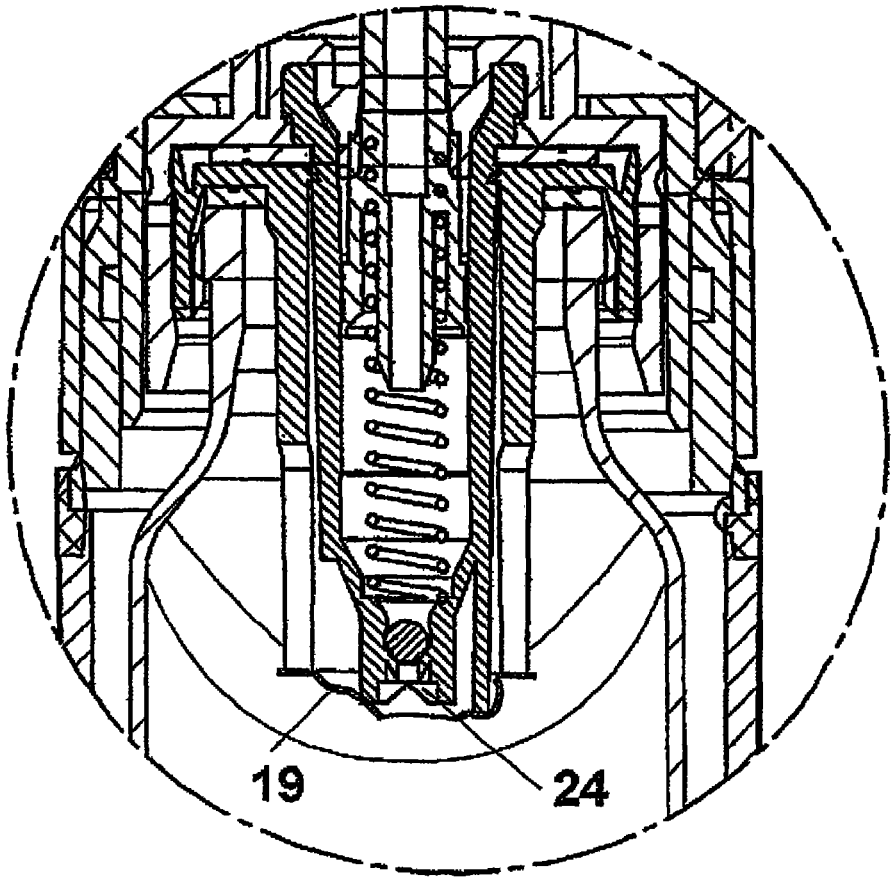
FIG. 4 is an illustration, similar to FIG. 3, but in the operative position of the airless pump.

FIG. 4 shows that the head end 20 of the suction part 9 of the pump 5 is provided with a cutting ring 24 which has cut open the arched chamber wall 19 of the blister pack 17.

Moreover, FIG. 4 shows details of the airless pump 5 which are known to the skilled person so that they are no longer described here. These details can be seen in FIG. 4.

It should be noted that the invention is not limited to the described and illustrated embodiments. Rather, all of the disclosed features can be combined with one another individually in any expedient way.

The invention claimed is:

1. A device for separately storing a substance, such as a pharmaceutical active substance, and a liquid, and for mixing the same prior to discharge, comprising a first receptacle containing the liquid, a second receptacle that contains the substance and has a bottom to be opened so that the substance can pass into the liquid, and comprising a means that can be advanced in order to apply a force to the bottom of the second receptacle such that the bottom is opened, further comprising a tubular insert which is inserted into a neck of the first receptacle, with the front part of a pump means displaceably engaging into the tubular insert and forming the force-exerting means, the front part of the pump means being held by a pump housing part which in the retracted initial position of the pump means defines an air chamber above the tubular insert, that a wall of the pump housing part has formed therein at least one opening through which upon the advance movement of the pump means air escapes outside the first receptacle, and the front part of the pump means being sealed on its outer circumference by an annular seal relative to the tubular insert.

2. The device according to claim 1, wherein the circumferential wall of the tubular insert comprises at least one opening, preferably at least two slits.

3. The device according to claim 1, wherein a cutting means is fastened to the free end of the front part of the pump means.

4. The device according to claim 1, wherein the second receptacle is a blister pack which is mounted on the tubular insert which projects into the first receptacle.

5. The device according to claim 1, wherein the tubular insert forms the second receptacle.

* * * * *